US008050608B2

(12) United States Patent
Chang

(10) Patent No.: US 8,050,608 B2
(45) Date of Patent: Nov. 1, 2011

(54) FUSING DEVICE AND IMAGE APPARATUS HAVING A BIASED PRESSING ROLLER

(75) Inventor: Hyuk Jae Chang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 584 days.

(21) Appl. No.: 12/153,476

(22) Filed: May 20, 2008

(65) Prior Publication Data

US 2009/0035033 A1 Feb. 5, 2009

(30) Foreign Application Priority Data

Aug. 2, 2007 (KR) ..... 10-2007-0077749
Dec. 31, 2007 (KR) ..... 10-2007-0141699

(51) Int. Cl.
*G03G 15/20* (2006.01)

(52) U.S. Cl. ..... 399/328

(58) Field of Classification Search ..... 399/328, 399/122, 329, 320; 219/216
See application file for complete search history.

(56) References Cited

U.S. PATENT DOCUMENTS 5,708,926 A * 1/1998 Sagara et al. ..... 399/122
7,483,665 B2 * 1/2009 Fujiwara et al. ..... 399/329
2004/0222214 A1 * 11/2004 Tomatsu ..... 219/494

FOREIGN PATENT DOCUMENTS

JP 63085777 A * 4/1988
JP 2005-257718 9/2005

* cited by examiner

*Primary Examiner* — Quana M Grainger
(74) *Attorney, Agent, or Firm* — Staas & Halsey LLP

(57) ABSTRACT

A fusing device comprising: a frame; a cover hinged to the frame, a heating roller mounted in the cover; a first pressing roller to form a first fusing nip through contact with the heating roller; a second pressing roller to form a second fusing nip, through which a printing medium passes, after passing through the first fusing nip; and a first resilient member connected to the frame and the cover, to bias the first and second pressing rollers toward the heating roller.

22 Claims, 8 Drawing Sheets

FUSING DEVICE AND IMAGE APPARATUS HAVING A BIASED PRESSING ROLLER

CROSS-REFERENCE TO RELATED APPLICATIONS

This application claims the benefit of Korean Patent Application Nos. 2007-77749 filed on Aug. 2, 2007 and 2007-141699 filed on Dec. 31, 2007, in the Korean Intellectual Property Office, the disclosure of which is incorporated herein by reference.

BACKGROUND OF THE INVENTION

1. Field of the Invention

Aspects of the present invention relate to an image forming apparatus, and more particularly, to a fusing device having improved performance and compactness, and an image forming apparatus having the same.

2. Description of the Related Art

In general, an image forming apparatus refers to an apparatus that forms an image on a printing medium, in accordance with input image signals. For example, a printer, a photocopier, a facsimile, and a multifunction peripheral (MFP) having combined functions of the aforementioned apparatuses, are examples of image forming apparatuses.

An electrophotographic image forming apparatus forms a desired image in the following process. First, a surface of a photoconductive medium is electrified to a predetermined electric potential. A laser beam is projected onto the surface of the photoconductive medium, to thereby form an electrostatic latent image. A toner image is obtained, by applying toner to the electrostatic latent image. Next, the toner image is transferred to a recording medium, and then fixed on the recording medium, by passing through a fusing device.

A fusing device generally comprises a heating roller including a heat source therein, and a pressing roller to form a fusing nip, through contact with the heating roller. As a printing medium, having a transferred toner image, is passed between the heating roller and the pressing roller, the toner image is fixed on the printing medium, by heat transmitted from the inside of the heating roller, and pressure between the heating roller and the pressing roller.

Currently, the tendency is toward high-speed and compact image forming apparatuses. Accordingly, fusing devices that have improved performance and a reduced size, are sought after.

Since the performance of a fusing device depends on the width of a fusing nip, it is preferable to enlarge a diameter of the pressing roller, to produce a higher performance fusing device. However, in this case, a diameter of the heating roller has to be accordingly enlarged, thereby increasing the size of the fusing device.

Considering such problems, a fusing device employing a pair of relatively small pressing rollers has been introduced, as shown in FIG. 1. The fusing device comprises a heating roller 1 including a heat source 1*a*, and first and second pressing rollers 2 and 3 disposed along a feeding direction of a printing medium M, and tightly contacting the heating roller 1. The first pressing roller 2 is biased toward the heating roller 1, by a first compression spring 4 mounted on the opposite side to the heating roller 1. The second pressing roller 3 is biased toward the heating roller 1, by a second compression spring 5. The use of the two pressing rollers 2 and 3 produces two fusing nips, which thereby increase a total nip area, resulting in the fusing device having improved fusing performance, while keeping a compact size.

In the fusing device shown in FIG. 1, however, the first compression spring 4 is mounted to the opposite side to the heating roller 1, to push the first pressing roller 2 toward the heating roller 1. In such a structure, the height of the fusing device should be increased, in order to secure a mounting space 6 for the first compression spring 4. This increases the size of the image forming apparatus.

Besides the performance improvement and the size reduction, a transfer path, along which the printing medium is transferred, is also a consideration. The printing medium can be curled as it passes through the fusing device. Without proper guidance, the curled printing medium may be jammed inside the fusing device, which can result in loss of image quality.

SUMMARY OF THE INVENTION

Aspects of the present invention has been made in order to solve the above and/or other problems. It is an aspect of the invention to provide a compact fusing device that has improved fusing performance, and an image forming apparatus having the same.

It is another aspect of the present invention to provide an improved fusing device capable of stably and smoothly passing a printing medium there through, without resulting in an inferior image, and an image forming apparatus having the same.

An exemplary embodiment of the present invention provides a fusing device comprising: a casing including a frame and a cover; a heating roller mounted in the cover; a first pressing roller disposed in the frame, to form a first fusing nip through contact with the heating roller; a second pressing roller disposed in the frame, downstream from the first pressing roller, with respect to an advancing direction of a printing medium, to form a second fusing nip through contact with the heating roller; and a first resilient member attached to the frame, to bias the first and second pressing rollers toward the heating roller.

According to aspects of the present invention, the frame may be hinged to the cover.

According to aspects of the present invention, the first resilient member may comprise a tension spring, which is connected to the frame and to the cover.

According to aspects of the present invention, the fusing device may further comprise a second resilient member, to bias the second pressing roller toward the heating roller.

According to aspects of the present invention, the second resilient member may comprise a compression spring, attached to the frame and the second pressing roller.

According to aspects of the present invention, the fusing device may further comprise: a supporting member connected to the second pressing roller, and resiliently supported by the second resilient member; and a pressure releasing lever pivotably connected to the supporting member. When the pressure releasing lever is pivoted, the frame is pivoted, so as to pull against the first resilient member, and the supporting member is moved away from the heating roller.

According to aspects of the present invention, an angle $\theta$1, formed by the intersection of a line X1, connecting axes of rotation of the heating roller and the first pressing roller, and a line X2, connecting axes of rotation of the heating roller and the second pressing roller, is approximately 45~55°.

According to aspects of the present invention, the fusing device may further comprise a guide claw to prevent the printing medium from curling around the heating roller, and including a contacting part to contact the heating roller.

According to aspects of the present invention, a distance A, from the line X2, to the contacting part, and a radius R of the heating roller, satisfy a following Equation:

$$0.6 \leqq A/R \leqq 0.96$$

According to aspects of the present invention, a distance B, from the contacting part to a line X3, which extends through the second fusing nip, and the radius R satisfy a following Equation:

$$0.16 \leqq B/R \leqq 0.4$$

According to aspects of the present invention, the guide claw may further include an outer surface extended from the contacting part, so as to face a transfer path of the printing medium. An angle θ2, formed by a line extending from the outer surface and the line X3, is approximately 0~8°

According to aspects of the present invention, the fusing device may further comprise a printing medium guides the printing medium after the printing medium passes through the second fusing nip.

According to aspects of the present invention, an angle θ3, formed between the line X3 and the printing medium guide, is approximately 140~160°.

According to aspects of the present invention, the fusing device may further comprise a first discharge guide roller disposed downstream of the printing medium guide, with respect to the advancing direction of the printing medium. An angle θ4, formed between the advancing direction of the printing medium at the second fusing nip, and an advancing direction at the first discharge guide roller, is approximately 120~140°

According to aspects of the present invention, the fusing device may further comprise a guide roller mounted to the printing medium guide. A radius R of the heating roller, and a distance C, from the second line X2, to a center of the guide roller, satisfy a following Equation:

$$1.2 \leqq C/R \leqq 2.4$$

According to aspects of the present invention, the fusing device may further comprise a first discharge guide roller mounted to the printing medium guide, downstream of the guide roller. The radius R and a distance D, from the line X2 to the center of the first discharge guide roller, satisfy a following Equation:

$$2 \leqq D/R \leqq 3.2$$

An exemplary embodiment of the present invention provides a fusing device comprising: a cover including a heating roller disposed therein; a frame hinged on one side to the cover; at least two pressing rollers mounted to the frame; and a tension spring resiliently supporting the frame, to bring the pressing rollers into tight contact with the heating roller.

An exemplary embodiment of the present invention provides an image forming apparatus comprising a fusing device. The fusing device comprises a cover to cover a heating roller disposed therein; a frame pivotably connected to the cover on one side; at least two pressing rollers mounted to the frame; and a first resilient member mounted between the cover and the frame, to push the frame toward the cover.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent, and more readily appreciated, from the following description of the exemplary embodiments, taken in conjunction with the accompanying drawings, of which.

DETAILED DESCRIPTION OF THE EMBODIMENTS

Figure 1:
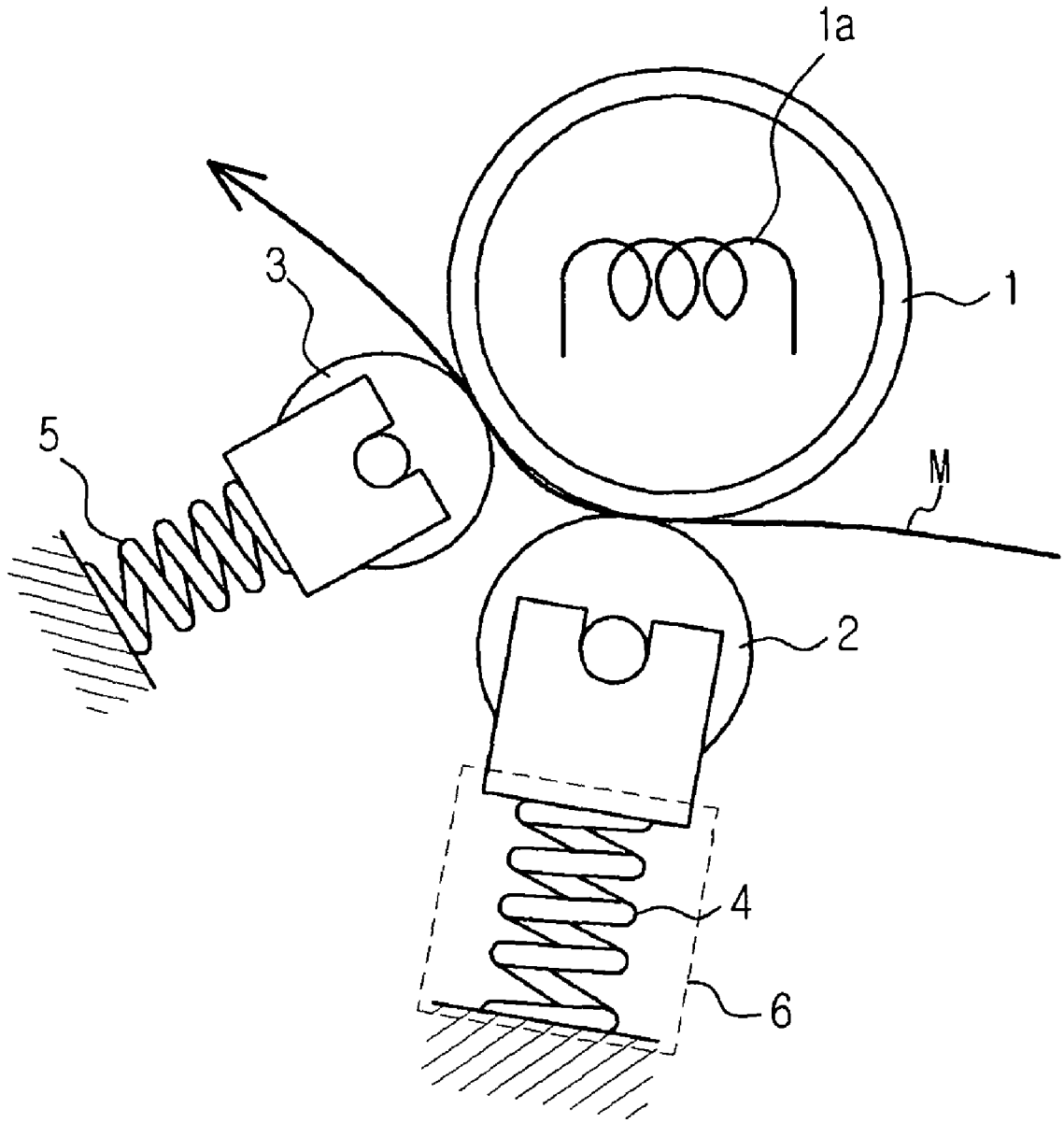
FIG. 1 shows the structure of a conventional fusing device.

Reference will now be made in detail to the exemplary embodiments of the present invention, examples of which are illustrated in the accompanying drawings, wherein like reference numerals refer to like elements throughout. The exemplary embodiments are described below, in order to explain the aspects of the present invention, by referring to the figures.

Figure 2:
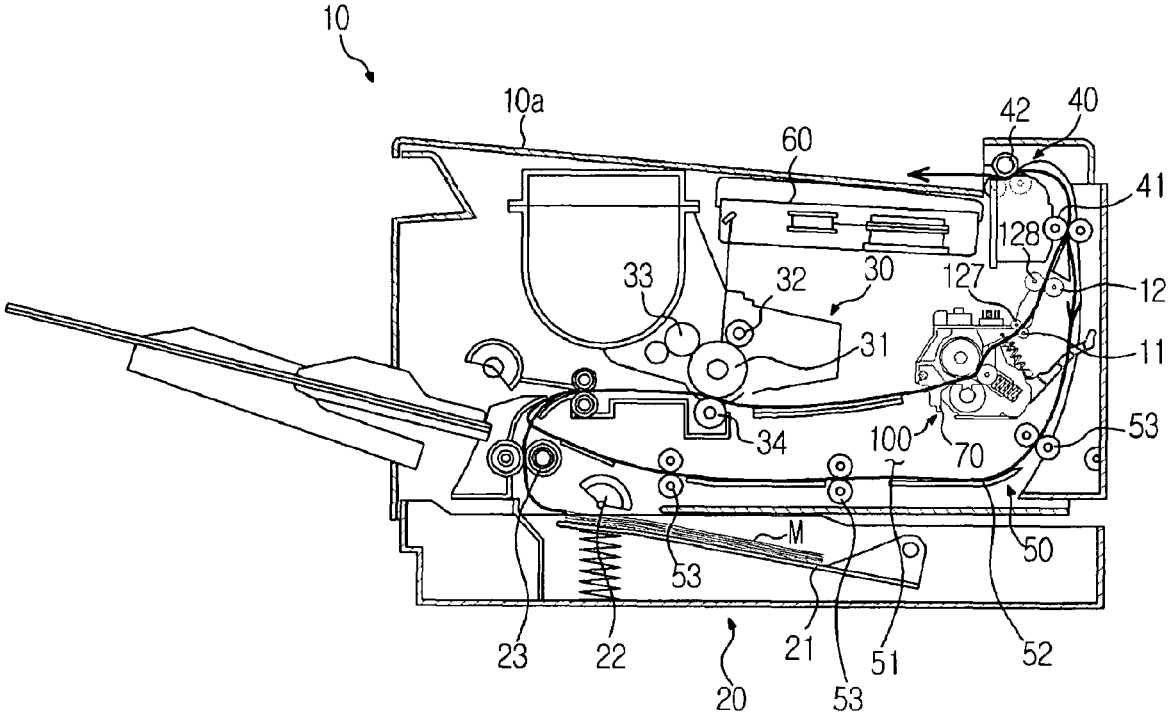
FIG. 2 shows the structure of an image forming apparatus, according to an exemplary embodiment of the present invention.

FIG. 2 is a view showing the structure of an image forming apparatus 10, according to an exemplary embodiment of the present invention. Referring to FIG. 2, the image forming apparatus 10 comprises a main body 10*a*, a printing medium feeding device 20, a developing device 30, a fusing device 100, a discharging device 40, and a duplex printing device 50.

The printing medium feeding device 20 feeds a printing medium M to the developing device 30. The printing medium feeding device 20 comprises a tray 21 to store the printing medium M, a pickup roller 22 to pickup the printing medium M from the tray 21, sheet by sheet, and a feeding roller 23 to feed the printing medium M to the developing device 30.

The developing device 30 develops an image, on the printing medium M fed from the printing medium feeding device 20. The developing device 30 comprises a photoconductive medium 31, upon which an electrostatic latent image is formed by a laser scanning device 60, an electrifying roller 32 to electrify the photoconductive medium 31, a developing roller 33 to developing the electrostatic latent image into a toner image, and a transferring roller 34 to press the printing medium M toward the photoconductive medium 31, so that the toner image is transferred from the photoconductive medium 31 to the printing medium M.

The fusing device 100 fixes the toner image onto the printing medium M, by applying heat and pressure to the printing medium M. An input guide 70 is mounted at an entrance of the fusing device 100, to guide entry of the printing medium M into the fusing device 100. The structure of the fusing device 100 will be described more specifically, hereinafter.

The discharging device 40 comprises first and second discharging rollers 41 and 42. The discharging device 40 discharges the printing medium M from the fusing device 100, out of the main body 10*a*.

The duplex printing device 50 feeds the printing medium M upstream to the developing device 30, in order to perform duplex printing. The duplex printing device 50 comprises a duplex printing guide 52 that defines a duplex printing path 51, and a series of duplex printing rollers 53 mounted along the duplex printing path 51, to feed the printing medium M.

The duplex printing is performed as follows. The printing medium M, while being discharged by the second discharging roller 42, is reversed at a predetermined point, and fed to the duplex printing path 51. Then, the printing medium M is returned to the developing device 30, by the duplex printing rollers 53, and is fed through the developing device 30 and the fusing device 100, thereby being printed with an image on a second side thereof.

Figure 3:
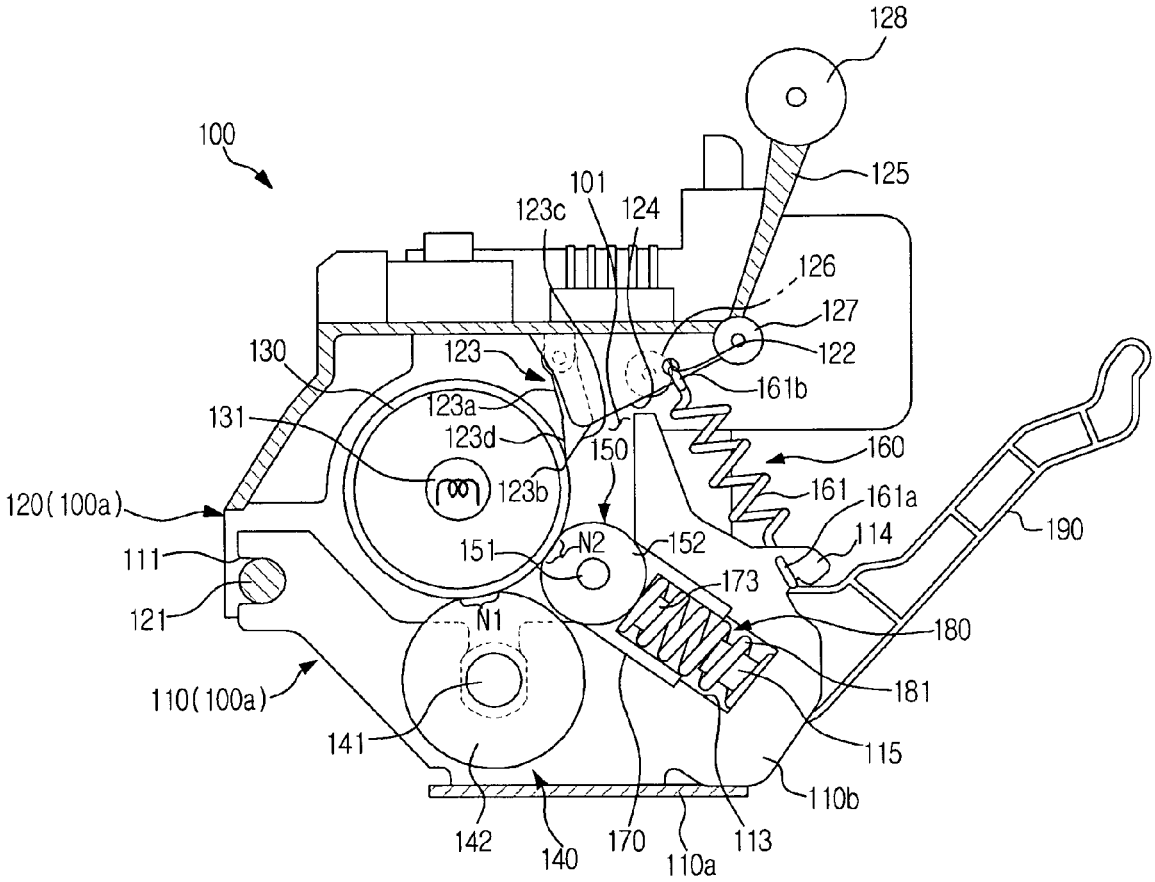
FIG. 3 shows the structure of a fusing device, according to an exemplary embodiment of the present invention.
Figure 4:
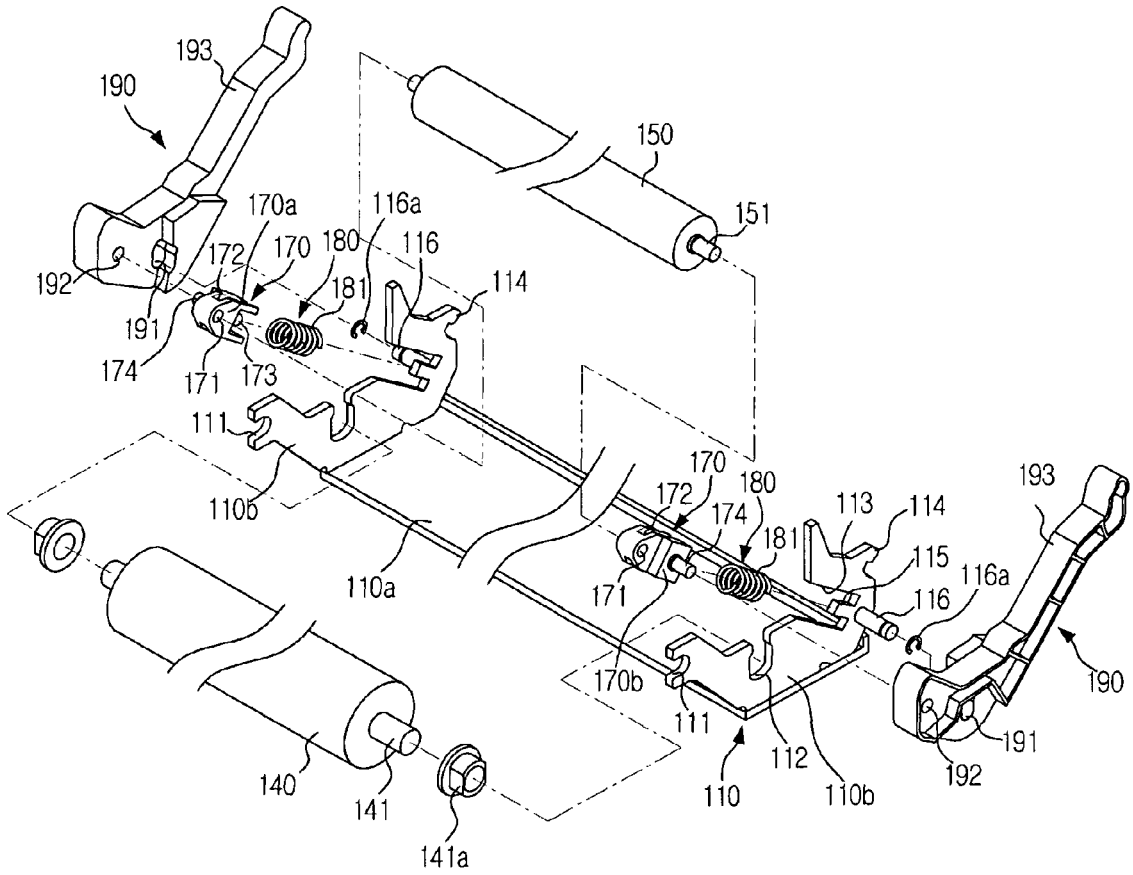
FIG. 4 is an exploded perspective view showing a fusing device, according to an exemplary embodiment of the present invention.
Figure 5:
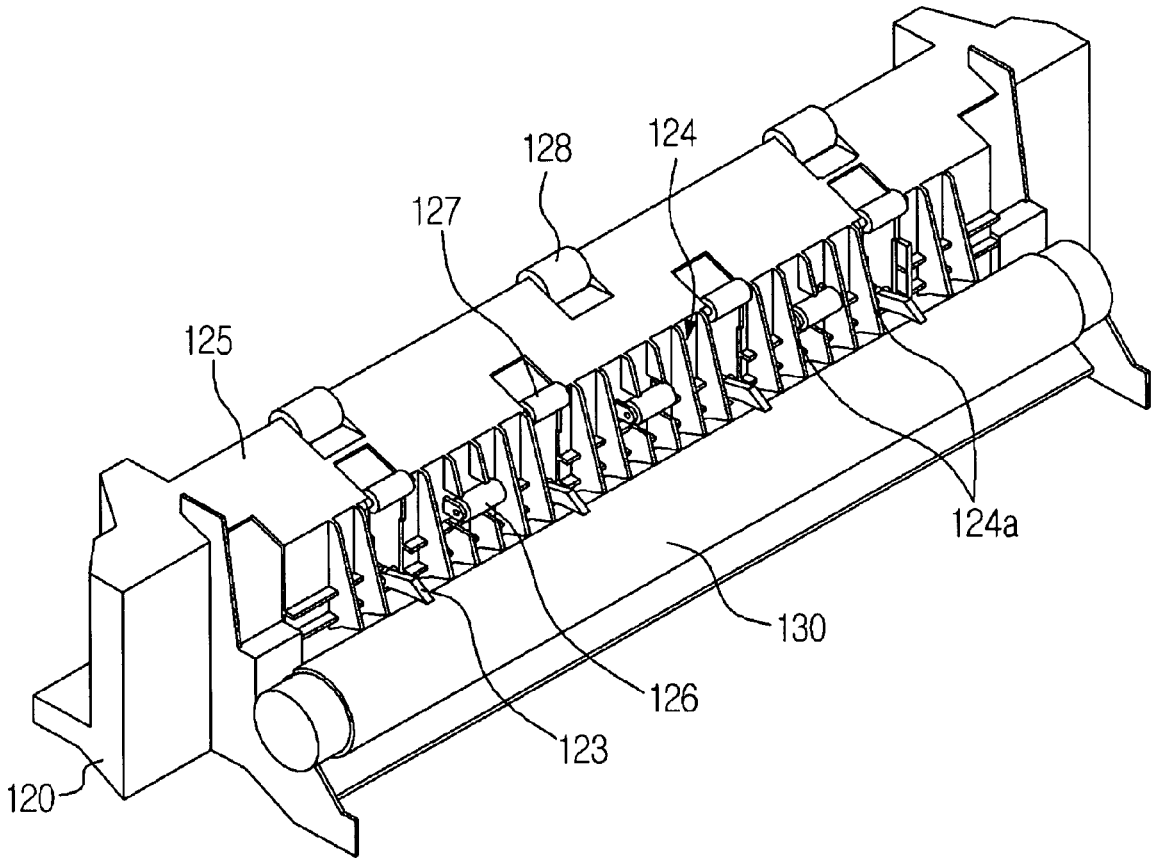
FIG. 5 is a perspective view of the fusing device of FIG. 4.

FIG. 3 shows the structure of the fusing device 100. FIG. 4 and FIG. 5 are exploded and perspective views of the fusing device 100.

As shown in FIG. 3, the fusing device 100 comprises a casing 100*a* including a frame 110 and a cover 120. A heating roller 130 is mounted to the cover 120, and first and second pressing rollers 140 and 150 are mounted to the frame 110, facing the heating roller 130. The first and second pressing rollers 140 and 150 are biased against the heating roller 130, to maintain a fusing pressure. Although two pressing rollers 140 and 150 are illustrated, the number of the pressing roller can be varied. The first pressing roller 140 is disposed upstream from the second pressing roller 150, with respect to a feeding direction of the printing medium.

The heating roller 130 includes a heat source 131 to heat the printing medium. The heat source 131 may be a halogen lamp, a hot wire, an induction heater, or the like.

The first and second pressing rollers 140 and 150 comprise first and second shafts 141 and 151, which are made of metal, such as aluminum, or steel. The first and second pressing rollers 140 and 150 comprise first and second resilient layers 142 and 152, which enclose the shafts 141 and 151, respectively. As the first pressing roller 140 is biased against the heating roller 130, the first resilient layer 142 is deformed, thereby forming a first fusing nip N1. As the second pressing roller 150 is biased against the heating roller 130, the second resilient layer 152 is deformed, thereby forming a second fusing nip N2. Generally, the first and second resilient layers 142 and 152 are made of silicon rubber. In addition, a release layer (not shown) can be provided on surfaces of the first and second resilient layers 142 and 152, to prevent the printing medium from sticking to the first and second pressing rollers 140 and 150.

As shown in FIG. 3 and FIG. 4, the frame 110 comprises a base panel 110*a*, and sidewalls 110*b* extending upward from both edges of the base panel 110*a*. Hinge recesses 111 are formed in each of the sidewalls 110*b*, to be connected with a hinge shaft 121 of the cover 120. The frame 110 is able to pivot about the hinge shaft 121.

The first and second pressing rollers 140 and 150 are mounted in the frame 110. Connection recesses 112 are formed in the sidewalls 110*b* of the frame 110. The first pressing roller 140 is disposed in the connection recesses 112. A connection boss 141*a* is connected with each end of the first shaft 141, of the pressing roller 140. When the connection boss 141*a* is fixed to the connection recesses 112, the pressing roller 140 can be rotatably mounted to the frame 110.

The frame 110 includes connection grooves 113 that are connected to each end of the second pressing roller 150. Each end of the second shaft 151, of the second pressing roller 150, is connected with a supporting member 170. The supporting members 170 are connected to the connection grooves 113 of the frame 110. The supporting members 170 have shaft connection holes 171, where the ends of the second shaft 151 are inserted. Guide recesses 172, where the frame 110 is partly inserted, are formed on both sides of the supporting member 170, such that the supporting member 170 can linearly move within the second connection grooves 113, when the supporting member 170 is connected to the frame 110.

First resilient members 160 are mounted between the frame 110 and the cover 120. Each first resilient member 160 pulls the frame 110 toward the cover 120, so that the first and second pressing rollers 140 and 150 are compressed against the heating roller 130.

The first resilient members 160 may comprise a tension springs 161, which are connected to the frame 110 and to the cover 120. Locking protrusions 114 are formed on the sidewalls 110*b*, to be engaged with locking hooks 161*a* formed at one end of the tension springs 161. Spring connection holes 122 is formed in the cover 120, to connect with locking hooks 161*b* formed opposing ends of the tension springs 120.

When employing the above-structured first resilient members 160, the fusing device 100 does not have to be tall to guarantee a mounting space of the first resilient members 160. Consequently, the whole image forming apparatus can be as compact as possible.

As the first resilient member 160 pulls the frame 110 toward the cover 120, the second pressing roller 150 is brought into tight contact with the heating roller 130. However, since the first resilient member 160 alone may be insufficient to properly compress the second pressing roller 150 against the heating roller 130, second resilient members 180 are further mounted between the supporting member 170 and the frame 110, to bias the second pressing roller 150 toward the heating roller 130.

The second resilient member 180 may comprise a compression spring 181. One end of the compression spring 181 is supported by the frame 110, while the other end supports the supporting member 170, which is connected with the second pressing roller 150. The frame 110 includes a first supporting protrusion 115 that is inserted in one end of the compression spring 181. The supporting member 170 includes a second supporting protrusion 173 inserted into the other end of the compression spring 181.

As shown in FIG. 4, inner and outer sides of the supporting members 170 are structured differently. More specifically, an inner surface 170*a* of the supporting members 170 is opened at a position where the compression spring 181 is inserted, so as to prevent interference with the compression spring 181, which is inserted in the second supporting protrusion 173. On the other hand, an outer surface 170*b* of the supporting members 170 is not opened. On the outer surface 170*b* a lever connection protrusion 174 is formed to be connected with a pressure releasing lever 190 that will be described hereinafter.

As shown in FIG. 3 and FIG. 5, the heating roller 130 is mounted on the cover 120. A guide claw 123 is mounted to the cover 120, to prevent the printing medium, which has passed through the second fusing nip N2, from curling around the heating roller 130.

The guide claw 123 comprises a claw body 123*a* including a contacting part 123*b* that contacts a surface of the heating roller 130, and a torsion spring (not shown) to bias the claw body 123*a* toward the heating roller 130, such that the contacting part 123*b* is pressed against the surface of the heating roller 130. The claw body 123*a* includes an outer surface 123*c* and an inner surface 123*d*, which meet each other at the contacting part 123*b*. The outer surface 123*c* of the claw body 123*a* faces a transfer path 101 of the printing medium. The printing medium contacts the outer surface 123*c* after it has passed through the second fusing nip N2. The inner surface 123*d* adjoins the surface of the heating roller 130.

The cover 120 includes a printing medium guide 124 to guide the printing medium, after the printing medium passes through the second fusing nip N2. The cover 120 includes a discharge guide 125 that extends from the printing medium guide 24, toward the discharging device 40 (FIG. 2).

The printing medium guide 124 comprises a plurality of guide ribs 124*a*. Guide rollers 126 are arranged along the width of the printing medium guide 124, in order to protect the image formed on the printing medium, while the printing medium is being guided by the guide ribs 124*a*.

The discharge guide 125 extends upward, and is bent from the printing medium guide 124. A plurality of first discharge guide rollers 127 are mounted to one end of the discharge guide 125, and a plurality of second guide rollers 128 are mounted to the other end. The first and second discharge guide rollers 127 and 128 rotate in engagement with driving rollers 11 and 12 (FIG. 2), which are mounted to the main body 10*a*, thereby delivering the printing medium from the second fusing nip N2 to the discharging device 40.

Thus, the fusing device 100 is designed to provide a stable passage of the printing medium, and to have a compact size. Therefore, the printing medium is prevented from jamming, and an image on the printing medium is protected during passage through the fusing device 100.

Figure 6:
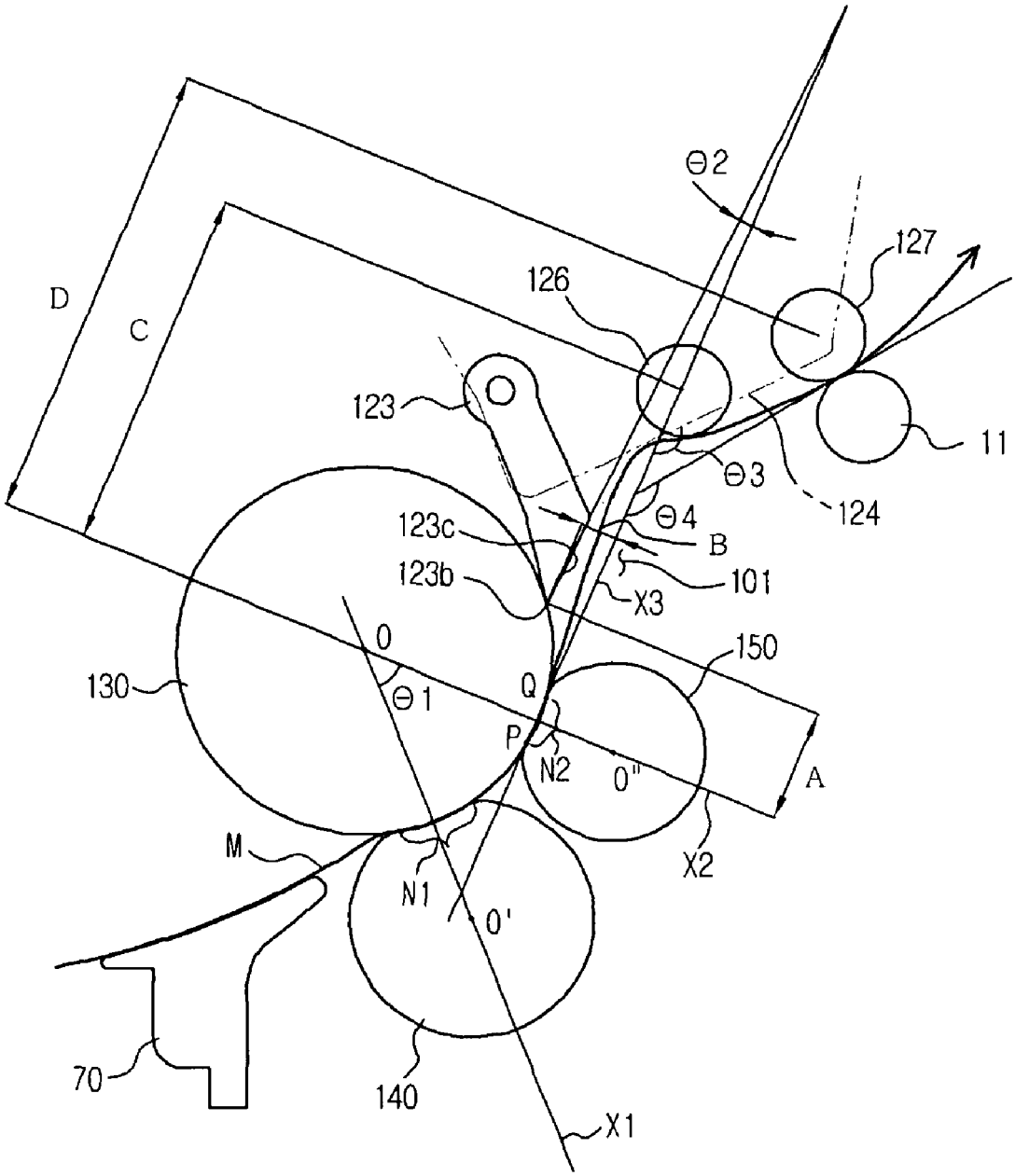
FIG. 6 illustrates positional relationships between component parts of a fusing device, according to an exemplary embodiment of the present invention.

FIG. 6 specifically shows the relative positions of the component parts of the fusing device 100. The line X1 denotes a line connecting the axis of rotation O of the heating roller 130, with the axis of rotation O' of the first pressing roller 140, and the reference numeral X2 is a line connecting the axis of rotation O with an axis of rotation O" of the second pressing roller 150. The angle θ1, which is formed by the lines X1 and X2, is about 44~55°.

When the angle θ1 is greater than 55° a distance between the first and second pressing rollers 140 and 150 increases, thereby increasing the size of the fusing device 100. While the printing medium M passes through the first fusing nip N1, and enters the second fusing nip N2, the image on the printing medium M may be distorted, by the heating roller 130 slipping on the image. A leading end of the printing medium M may collide with the second pressing roller 150, thereby causing the jam at the second nip N2.

When the angle θ1 is less than 45°, the distance between the two pressing rollers 140 and 150 decreases. Accordingly, the fusing device 100 should be designed so as not to cause interference between the pressing rollers 140 and 150. Moreover, when the angle θ1 is extremely small, the size of the pressing rollers 140 and 150 should be decreased accordingly. This decrease can result in a reduction in the sizes of the fusing nips N1 and N2, and accordingly, a reduction in fusing performance.

The radius R of the heating roller 130, and the distance A, from the line X2 to the contacting part 123*b* of the guide claw 123, (the line X2 connecting the axis of rotation O of the heating roller 130 with the axis of rotation O" of the second pressing roller 150), satisfy the following Equation 1:

$$0.6 \leqq A/R \leqq 0.96 \quad \text{(Equation 1)}$$

The line X3 is a line connecting the uppermost point P and the lowermost point Q, of the second fusing nip N2. The distance B, from the line X3 to the contacting part 123*b*, and the radius R of the pressing roller 130 satisfy the following Equation 2:

$$0.16 \leqq B/R \leqq 0.4 \quad \text{(Equation 2)}$$

For example, presuming that the radius R of the pressing roller 130 is approximately 12.5 mm, the distance A ranges from 7.5 mm to 12 mm, and the distance B ranges from 2 mm to 5 mm.

The guide claw 123 is used to detach the printing medium M from the heating roller 130, if the printing medium M curls around the heating roller 130. Therefore, when the printing is normally performed, the guide claw 123 does not contact the printing medium M. However, if the distance A, between the line X2 and the contacting part 123*b*, or the distance B, between the line X3 and the contacting part 123*b*, are extremely small, the printing medium M may contact the outer surface 123*c* of the guide claw 123 during the normal operation, thereby damaging the image.

If the distances A or B are too great, the printing medium M reaches the guide claw 123 after curling around the pressing roller 130 by a considerable degree. Therefore, although the guide claw 123 detaches the printing medium M from the heating roller 130, a jam of the printing medium M in the fusing device 100 may not be prevented. As a consequence, the guide claw 123 is designed according to Equation 1 and Equation 2, to prevent generation of an inferior image and the jam.

In addition, the angle θ2, between a line extending along the outer surface 123*c* of the guide claw 123, and the line X3, can be about 0~8°, such that the outer surface 123 does not significantly protrude into the transfer path 101 of the printing medium M, thereby preventing the image from being damaged by friction between the printing medium M and the guide claw 123.

The printing medium M passing through the first and second fusing nips N1 and N2 is apt to be curled around the heating roller 130. The curl can be reduced by bending the printing medium M in the opposite direction of the curl, before the printing medium M is completely cooled. The printing medium guide 124, which is mounted downstream of the second fusing nip N2, smoothly guides the printing medium M, after the printing medium M passes through the second fusing nip N2, thereby relieving the curl of the printing medium M.

The printing medium guide 124 forms the angle E3, between the line X3, connecting the uppermost point P and the lowermost point Q of the second fusing nip N2, and the angle θ3 can be about 140~160°. When the angle θ3 is greater than 160°, the printing medium guide 124 becomes almost parallel with an advancing direction of the printing medium M, as the printing medium M passes through the second fusing nip N2. In this case, the curl of the printing medium M may not be effectively relieved.

Relief of the curl is more efficient if the angle θ3 is smaller. If the angle θ3 is too small, however, the advancing direction of the printing medium M is changed abruptly, also causing damage to the image, or a jam. Thus, the angle θ3 is generally no more that about 140°. Also, the advancing direction of the printing medium M through the second fusing nip N2, and the advancing direction through the first discharge guide roller 127 form the angle θ4. The angle θ4 is generally about 120~140°, so that the printing medium M can smoothly enter between the first discharge guide roller 127 and the driving roller 11, under the guidance of the printing medium guide 124.

The distance C along the line X2, is the distance between the axis of rotation O of the heating roller 130, and the axis of rotation O" of the second pressing roller 150. The distance C can be $1.2 \leqq C/R \leqq 2.4$. For example, when the radius R is approximately 12.5 mm, the distance C can range from 15 mm to 30 mm.

If the distance C is too great, the printing medium M reaches the guide roller 216 after suffering much friction with the printing medium guide 124. Therefore, damage to the image is not effectively prevented. If the distance C is too small, the printing medium M may pass by the guide roller 126, and be guided only by the printing medium guide 124, which is downstream of the guide roller 126. That is, the guide roller 126 may become useless.

The radius R, and the distance D, between the line X2 and the axis of rotation of the first discharge guide roller 127, can be $2 \leqq D/R \leqq 3.2$. For example, when the radius R is approximately 12.5 mm, the distance D ranges from 25 mm to 40 mm.

If the distance D is too great, the image can be damaged, due to friction between the printing medium M and the printing medium guide 124. If the distance D is too small, the configuration of the components, with regard to the guide roller 126, can be unnecessarily complicated.

As shown in FIG. 3 and FIG. 4, the fusing device 100 comprises the pressure releasing lever 190, which relieves the pressure between the pressing rollers 140 and 150, and the heating roller 130. The fusing device can comprise two pressure releasing levers 190. When the printing medium is jammed among the pressing rollers 140 and 150, and the heating roller 130, a user is able to remove the jammed printing medium, using the pressure releasing lever 190.

Figure 7:
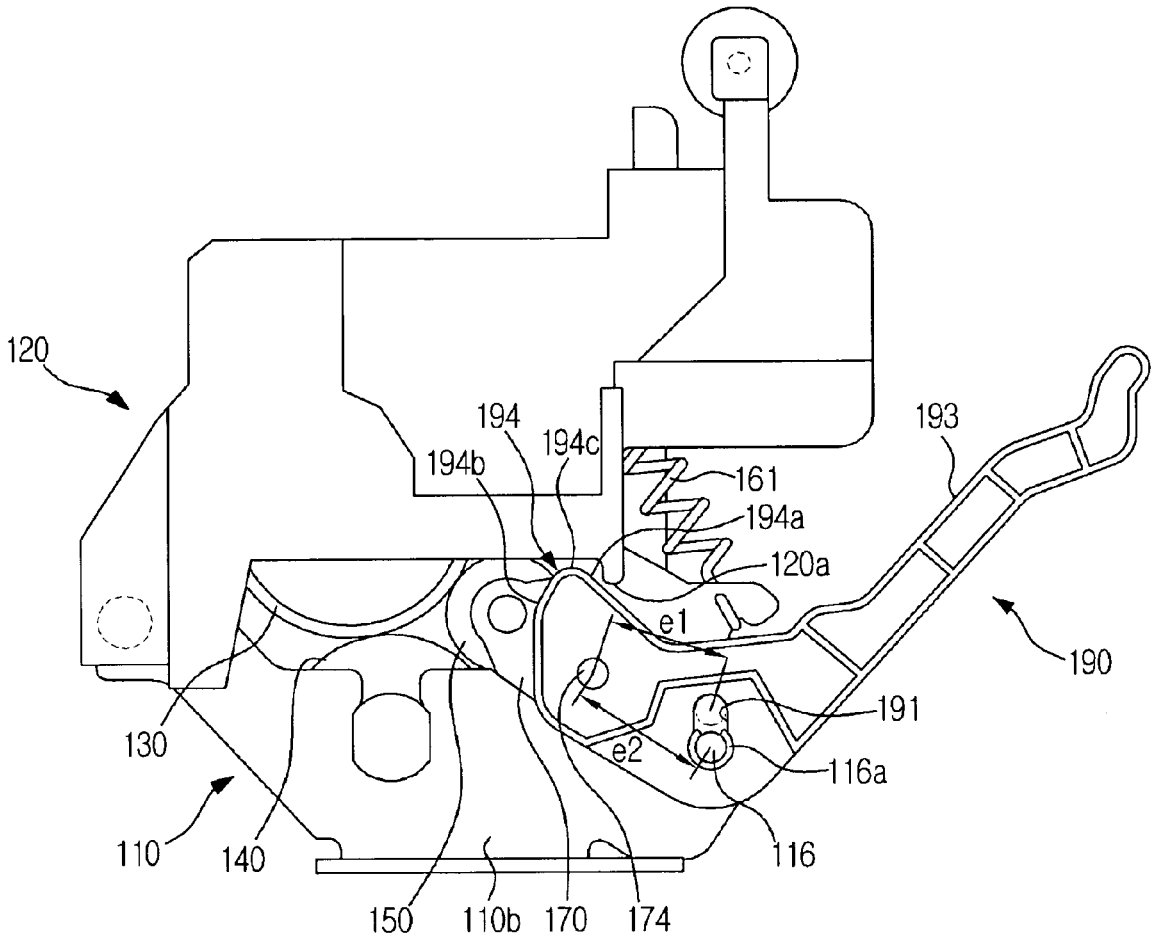
FIG. 7 and FIG. 8 illustrate the operation of a pressure releasing lever of a fusing device, according to an exemplary embodiment of the present invention.
Figure 8:
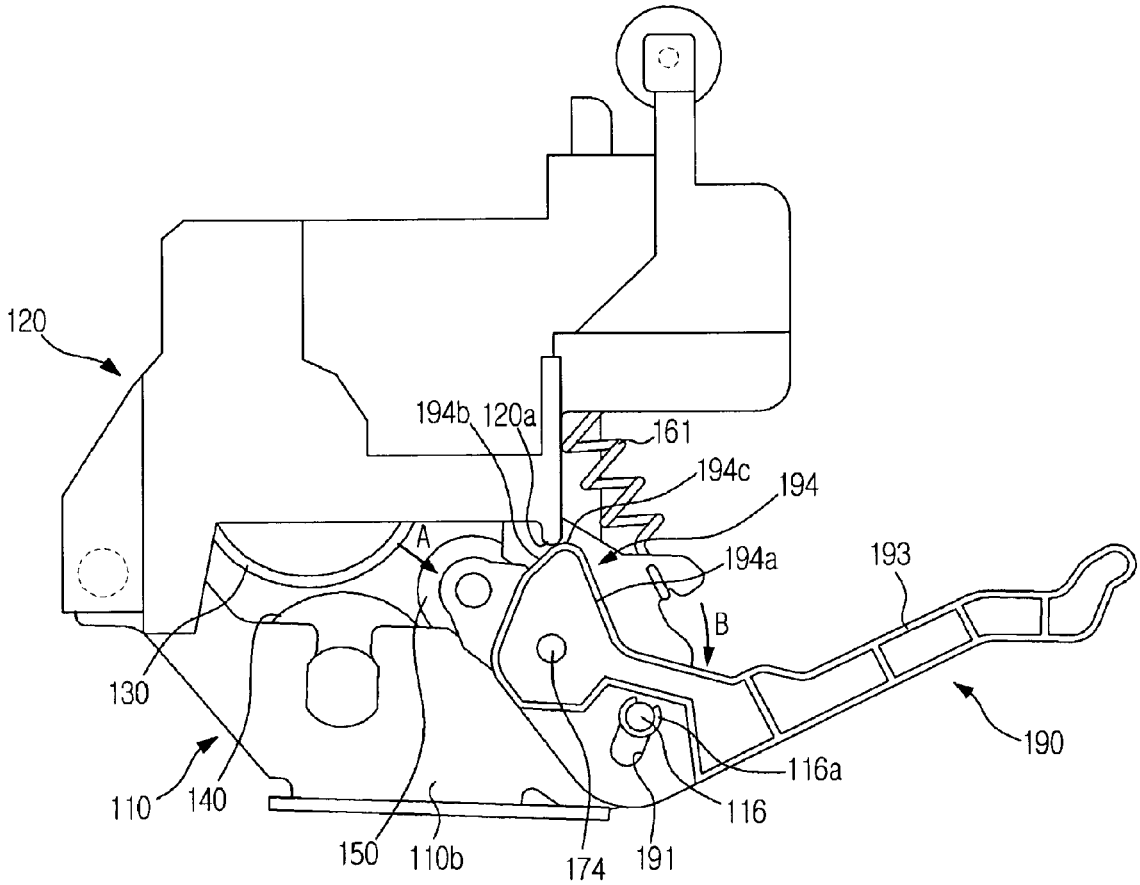

FIG. 7 and FIG. 8 explain the operation of the pressure releasing lever 190. More specifically, FIG. 7 shows the pressing rollers 140 and 150 biased against the heating roller 130. FIG. 8 shows the pressing rollers 140 and 150 spaced apart from the heating roller 130, by the action of the pressure releasing lever 190.

Referring to FIG. 4, FIG. 7, and FIG. 8, a lever guide protrusion 116 is formed at the sidewall 110*b* of the frame 110. The pressure releasing lever 190 includes a guide slot 191, for engagement with the lever guide protrusion 116.

In FIG. 7, the lever guide protrusion 116 is disposed at a lower part of the guide slot 191. A washer 116*a* is connected to the lever guide protrusion 116, to prevent the separation of the pressure releasing lever 190.

The pressure releasing lever 190 includes a supporting member connection hole 192, which is connected with the lever connection protrusion 174 of the supporting member 170. When a user lowers or lifts a handle 193 of the pressure releasing lever 190, the pressure releasing lever 190 pivots up and down about the lever connection protrusion 174. More specifically, when the user lowers the handle 193, as shown in FIG. 7, the guide slot 191 is pivoted downward with respect to the lever connection protrusion 174. Accordingly, the lever guide protrusion 116 is moved to an upper part of the guide slot 191, as shown in FIG. 8.

Here, the distance E1, between the lever connection protrusion 174 and the lever guide protrusion 116, when the lever guide protrusion 116 is disposed as shown by an dashed line in FIG. 7, is shorter than a distance E2, between the protrusions 174 and 116, when the lever guide protrusion 116 is at the lower part. Therefore, by pivoting of the pressure releasing lever 190, the supporting member 170 is moved in the direction A, as shown in FIG. 8, thereby disengaging the second pressing roller 150 and the heating roller 130.

The pressure releasing lever 190 includes an interfering part 194 to interfere with the cover 120 during its pivoting. The interfering part 194 is protruded toward the cover 120, from one end of the pressure releasing lever 190. According to a downward operation of the handle 193, the interfering part 194 is pivoted about the lever connection protrusion 174, thereby interfering with a lower part of the cover 120.

Hereinafter, the operation of the interfering part 194, when interfering with the cover 120, will be described in greater detail. As shown in FIG. 7, when the user lowers the handle 193, a first surface 194*a* of the interfering part 194 is brought into contact with the cover 120. If the user further lowers the handle 193, the interfering part 194 pushes against the cover 120. However, since the cover 120 is fixed to the main body 10*a*, the frame 110 is pivoted by the force of the pressure releasing lever 190, in the direction B. The first pressing roller 140 is accordingly moved along with the frame 110. As a result, the pressure between the first pressing roller 140 and the heating roller 130 is released.

FIG. 8 shows the pressure releasing lever 190 when fully pivoted. In this state, a second surface 194*b* of the interfering part 194 is in contact with an edge 120*a* of the cover 120, and the edge 120*a* is supported by a peak 194*c* of the interfering part 194, between the first and second surfaces 194*a* and 194*b*. Therefore, the state of FIG. 8 can be maintained without any external force exerted to the pressure releasing lever 190.

As described above, a user is able to release the fusing pressure between the first and second pressing rollers 140 and 150, and the heating roller 130, as necessary, by using the pressure releasing lever 190. When the pressure is released, a jammed printing medium can be easily removed. After removing the jammed printing medium, the user can restore the rollers to the state of FIG. 7, by lifting the handle 193 of the pressure releasing lever 190.

As can be appreciated from the above description, the fusing device, according to aspects of the present invention, has improved fusing performance, by employing a plurality of pressing rollers. Also, since a mounting structure for a resilient member, which pushes the pressing rollers toward a heating roller, is improved, the height of the fusing device is not unnecessarily increased, to secure a mounting space of the resilient member. Consequently, the image forming apparatus can be compactly structured.

All component parts in the fusing device are disposed at a proper arrangement, so that the printing medium is able to move stably, without causing a jam or damage to an image. A fusing pressure, between each of the pressing rollers and the heating roller, can be easily achieved using one pressure releasing lever. Therefore, although a jam of the printing medium occurs, the user can conveniently remove the jammed printing medium from the fusing device.

Although a few exemplary embodiments of the present invention have been shown and described, it would be appreciated by those skilled in the art that changes may be made in these embodiments, without departing from the principles and spirit of the invention, the scope of which is defined in the claims and their equivalents.

What is claimed is:

1. A fusing device comprising:

a frame;

a cover mounted to the frame;

a heating roller mounted to the cover;

a first pressing roller mounted to the frame, to form a first fusing nip through contact with the heating roller;

a second pressing roller mounted to the frame, to form a second fusing nip through contact with the heating roller, through which a printing medium passes after passing through the first fusing nip;

a first resilient member to bias the frame, so as to bias the first and second pressing rollers toward the heating roller; and a second resilient member to bias the second pressing roller toward the heating roller.

2. The fusing device according to claim 1, wherein the frame is hinged on one side, to the cover.

3. The fusing device according to claim 1, wherein the first resilient member comprises a tension spring connected to the frame and to the cover.

4. The fusing device according to claim 1, wherein the second resilient member comprises a compression spring, connected to the frame and the second pressing roller.

5. The fusing device according to claim 1, further comprising:

a supporting member connected to the second pressing roller, and resiliently supported by the second resilient member; and a pressure releasing lever pivotably connected to the supporting member, wherein, when the pressure releasing lever pivots the frame away from the cover, such that the first resilient member and the supporting member are moved away from the heating roller.

6. The fusing device according to claim 1, wherein:

an angle θ1 is approximately 45~55°;

the angle θ1 is formed by lines X1 and X2;

the line X1 extends through the axes of rotation of the heating roller and the first pressing roller; and the line X2 extends through the axes of rotation of the heating roller and the second pressing roller.

7. The fusing device according to claim 1, further comprising a guide claw to prevent the printing medium from curling around the heating roller, after the printing medium passes through the second fusing nip, the guide claw having a contacting part to contact the heating roller.

8. The fusing device according to claim 7, wherein:

$$0.6 \leqq A/R \leqq 0.96;$$

X2 is a line that extends through the axes of rotation of the heating roller and the second pressing roller;

A is the shortest distance between to the contacting part and the line X2; and

R is the radius of the heating roller.

9. The fusing device according to claim 7, wherein:

$$0.16 \leqq B/R \leqq 0.4;$$

X3 is a line that extends through the second fusing nip, in an advancing direction of the printing medium through the second fusing nip;

B is the shortest distance between the line X3 and the contacting part;

R is the radius of the heating roller.

10. The fusing device according to claim 7, wherein:

the guide claw has an outer surface that extends from the contacting part, and faces the printing medium transfer path;

an angle θ2 is approximately 0~8°; and the angle θ2 is formed by a line that extends in parallel to the outer surface, and a line X3 that extends through the second fusing nip, in an advancing direction of the printing medium through the second fusing nip.

11. A fusing device comprising:

a frame;

a cover mounted to the frame;

a heating roller mounted to the cover;

a first pressing roller mounted to the frame, to form a first fusing nip through contact with the heating roller;

a second pressing roller mounted to the frame, to form a second fusing nip through contact with the heating roller, through which a printing medium passes after passing through the first fusing nip;

a first resilient member to bias the frame, so as to bias the first and second pressing rollers toward the heating roller; and a printing medium guide to guide the printing medium, after the printing medium passes through the second fusing nip.

12. The fusing device according to claim 11, wherein:

an angle θ3 is approximately 140~160°;

the angle θ3 is formed by a line X3 that extends through the second fusing nip, in an advancing direction of the printing medium through the second fusing nip, and a line that extends along the printing medium guide, in an advancing direction of the printing medium across the printing medium guide.

13. The fusing device according to claim 12, further comprising a discharge guide roller mounted on the printing medium guide, to roll in contact with the printing medium, wherein, an angle θ4 is approximately 120~140°, and the angle θ4 is formed by an advancing direction of the printing medium through the second fusing nip, and an advancing direction of the printing medium across the discharge guide roller.

14. The fusing device according to claim 11, further comprising a guide roller mounted to the printing medium guide, wherein:

$$1.2 \leqq C/R \leqq 2.4;$$

R is the radius of the heating roller;

C is the distance between a line X2, and the axis of rotation of the heating roller; and the line X2 extends through the axes of rotation of the heating roller and the second pressing roller.

15. The fusing device according to claim 14, further comprising a discharge guide roller mounted to the printing medium guide, to contact the printing medium after the printing medium contacts the guide roller, wherein:

$$2 \leqq D/R \leqq 3.2; \text{ and}$$

D is the shortest distance between the line X2, and the axis of rotation of the discharge guide roller.

16. A fusing device comprising:

a frame;

a cover hinged to the frame;

a heating roller mounted to the cover;

at least two pressing rollers mounted to the frame;

a tension spring to resiliently support the frame, to bias the pressing rollers against the heating roller; and a resilient member to additionally bias one of the pressing rollers toward the heating roller.

17. An image forming apparatus comprising a fusing device, the fusing device comprising:

a frame;

a cover having a first side that is hinged to the frame;

a heating roller mounted to the cover;

pressing rollers mounted to the frame; and a first resilient member mounted to the cover and the frame, to bias a second side of the frame toward the cover; and a second resilient member to bias one of the pressing rollers toward the heating roller.

18. The image forming apparatus according to claim 17, wherein the first resilient member comprises a tension spring.

19. The image forming apparatus according to claim 17, wherein:

the pressing rollers comprise a first pressing roller to form a first fusing nip with the heating roller, and a second pressing roller to form a second fusing nip with the heating roller;

an angle θ1 is approximately 45~55°;

the angle θ1 is formed by a line X1 and a line X2;

the line X1 extends through the axes of rotation of the heating roller and the first pressing roller; and the line X2 extends through the axes of rotation of the heating roller and the second pressing roller.

20. The image forming apparatus according to claim 19, further comprising a guide claw to prevent a printing medium nip from curling around the heating roller, having a contacting part to contact the heating roller, and an outer surface that extends from the contacting part, and faces a printing medium transfer path, wherein:

$$0.6 \leqq A/R \leqq 0.96;$$

$$0.16 \leqq B/R \leqq 0.4;$$

A is the shortest distance between to the contacting part and the line X2;

R is the radius of the heating roller;

B is the shortest distance between a line X3 and the contacting part; and the line X3 extends through the second fusing nip, in an advancing direction of the printing medium through the second fusion nip.

21. The image forming apparatus according to claim 20, wherein:

an angle θ2 is approximately 0~8°;

the angle θ2 is formed by a line extending in parallel to the outer surface, and the line X3.

22. The image forming apparatus according to claim 19, further comprising a printing medium guide to guide the printing medium, after the printing medium passes through the second fusing nip, wherein:

an angle θ3 is approximately 140~160°;

the angle θ3 is formed by a line X3 that extends through the second fusing nip, in an advancing direction of the printing medium through the second fusing nip, and a line that extends past the printing medium guide, in an advancing direction of the printing medium across the printing medium guide.

* * * * *